United States Patent [19]

Pannell

[11] 4,054,188

[45] Oct. 18, 1977

[54] ROPE STOP AND HOLDING DEVICE

[76] Inventor: Otis R. Pannell, 9023 Mcnair Drive, Alexandria, Va. 22309

[21] Appl. No.: 676,272

[22] Filed: Apr. 12, 1976

[51] Int. Cl.[2] ..... B65H 59/14

[52] U.S. Cl. ..... 188/65.3; 188/65.4; 188/65.5; 226/39; 226/48; 226/195; 242/153; 242/156; 254/156

[58] Field of Search ..... 188/65.1, 65.4, 65.5, 188/65.3; 192/85 AA, 85 R; 226/39, 48, 195; 254/156; 242/156, 153; 182/5, 6, 7

[56] References Cited

U.S. PATENT DOCUMENTS

| | | | |
|---|---|---|---|
| 126,483 | 5/1872 | Perkins | 242/154 |
| 439,529 | 10/1890 | Larsen | 188/65.5 |
| 2,833,491 | 5/1958 | Carroll | 242/154 |
| 3,074,261 | 1/1963 | Wilcox | 226/39 X |
| 3,143,309 | 8/1964 | Clarke | 226/195 X |

FOREIGN PATENT DOCUMENTS

| | | | |
|---|---|---|---|
| 167,436 | 4/1956 | Australia | 226/195 |
| 501,258 | 4/1954 | Canada | 226/48 |
| 801,583 | 12/1968 | Canada | 242/154 |

*Primary Examiner*—George E. A. Halvosa
*Attorney, Agent, or Firm*—Nathan Edelberg

[57] ABSTRACT

Apparatus for stopping and holding a rope is disclosed. The apparatus includes a power drum, a wind up mechanism having two small drums and an air operated chain drive system between the power drum and the wind up mechanism. A rope is threaded through the apparatus such that the rope passes between the two drums of the wind up mechanism and is wrapped once around the power drum. When the chain drive system is not energized, the rope is free to move in either direction through the apparatus; however, when the chain drive system is energized, the rope is wrapped around the two small drums of the wind up mechanism and is thereby stopped and held under tension from further pay out through the apparatus.

3 Claims, 3 Drawing Figures

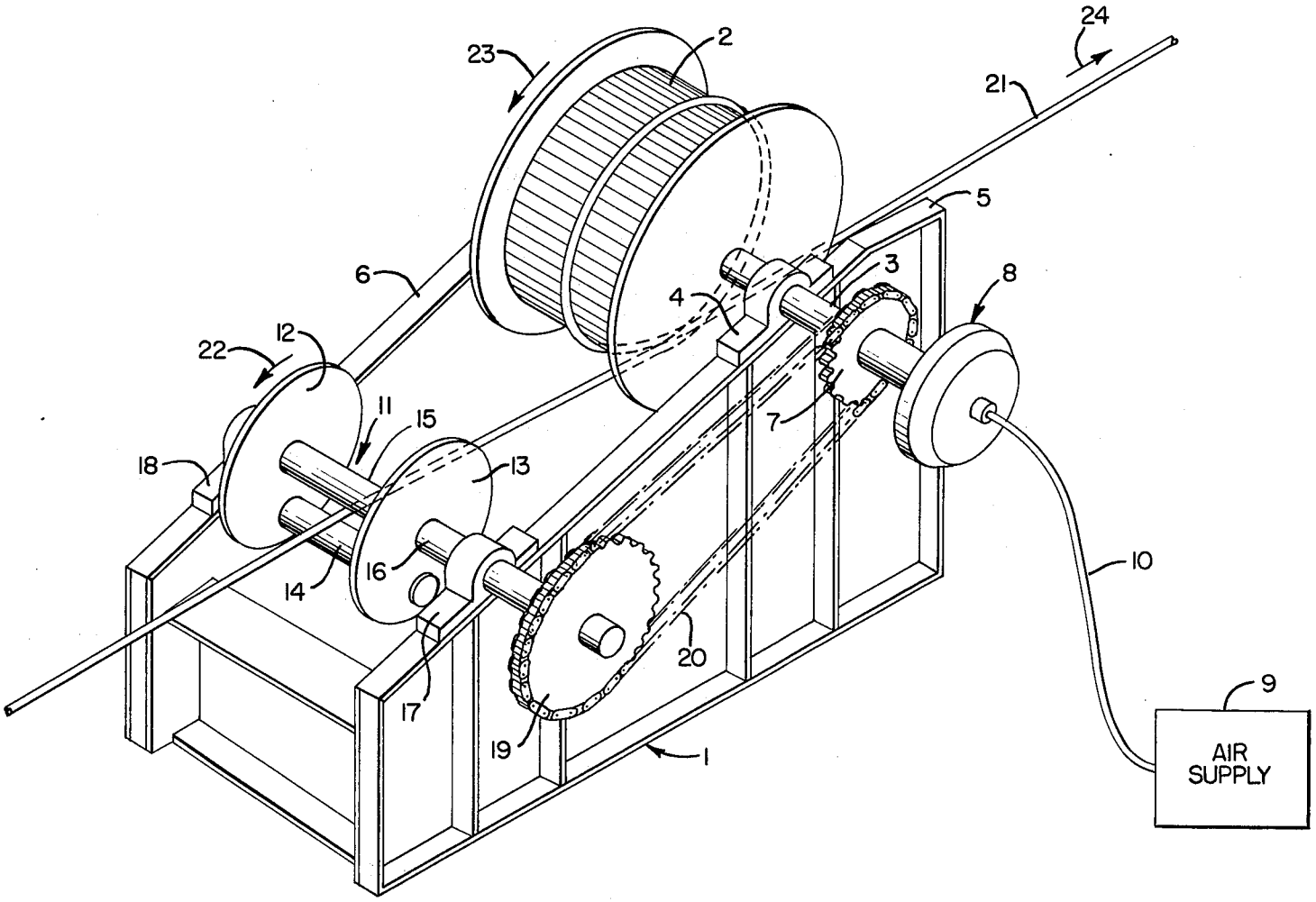
AIR SUPPLY
9
10
8
24
21
5
3
7
2
4
20
1
23
19
13
15
17
11
16
6
12
14
22
18

ROPE STOP AND HOLDING DEVICE

The invention described herein may be manufactured, used, and licensed by or for the Government for Governmental purposes without the payment to me of any royalities thereon.

BACKGROUND OF THE INVENTION

This invention relates to rope handling apparatus, and more particularly, to apparatus for stopping and holding a rope.

There are many applications where a rope must be stopped from further pay out and held under tension. Examples of such applications are as follows:

1. The installation of tactical tanker offloading pipeline systems;

2. As a safety device to prevent runaway of a line in the event of a mishap while catheading a line; and 3. To hold a ship's mooring line under tension without slippage. There are, of course, numerous other applications in which a line must be stopped and held as will be apparent to those skilled in the art. This invention provides a rope stopping and holding system that is relatively simple in construction and is easily incorporated into a rope handling system. The apparatus of this invention when engaged will stop the further pay out of a rope and will hold a rope uner high tension without any slippage. When disengaged, the apparatus permits free movement of the rope without any interference to the paying out and retrieving of the rope.

SUMMARY OF THE INVENTION

This invention relates to apparatus for the stopping and holding of a rope. This apparatus includes a power drum, a wind up mechanism having two small drums and an air operated chain drive system.

A rope that is to be controlled by the apparatus is threaded between the two drums of the wind up mechanism and wrapped once around the power drum. As long as the air operated chain drive system remains disengaged the rope will freely move through the apparatus in either direction. When the air operated chain drive is engaged, the rope is wrapped around the two small drums of the wind up mechanism and held from further movement.

BRIEF DESCRIPTION OF THE DRAWING

A full and complete understanding of the invention can be obtained from the following detailed description of the invention when read in conjunction with the annexed drawing in which the single FIGURE shows a preferred embodiment of the invention.

DETAILED DESCRIPTION OF THE INVENTION

Referring to the drawing, the apparatus of the invention is mounted on a support structure 1. While the exact design and configuration of the support structure 1 is not critical, the configuration of support structure 1 as shown in the drawing is a convenient and functional configuration.

A power drum 2 which is a spool or reel type drum is carried by the shaft 3 which passes through the bearing 4 which is secured to the ledge 5 of support structure 1. Bearing 4 is secured to ledge 5 by any suitable means. Shaft 3, of course, passes through power drum 2 and the end of shaft 3 that is not visible in the drawing is carried in a bearing (not shown in the drawing) similar to bearing 3. This bearing is secured to the ledge 6 of support structure 1. Shaft 3 extends a considerable distance beyond bearing 3 and has secured thereto a sprocket 7 and an air clutch 8. Air clutch 8 is connected to the air supply 9 which may be an air compressor, for example, by means of the air hose 10.

A wind up mechanism 11 is also carried by support structure 1. Wind up mechanism 11 includes a pair of end discs 12 and 13 and two small drums 14 and 15. Wind up mechanism 11 is carried by the shaft 16 which may be a one-piece shaft or may be made up of two sections. If shaft 16 is one piece, then shaft 16 passes through discs 12 and 13 and drum 15 is formed by the part of shaft 16 that is between discs 12 and 13. If shaft 16 is a two-piece shaft, one part is secured to the outer face of disc 12 and the other part is secured to the outer face of disc 13 and drum 15 is not part of shaft 16. In any event, shaft 16 rides in the bearings 17 and 18 which are secured to the ledges 5 and 6, respectively, of support structure 1. Shaft 16 extends beyond bearings 17 and a spocket 19 is secured to shaft 16. A chain 20 couples sprocket 19 to sprocket 7.

In operation, a rope 21 is threaded between drums 14 and 15 and wrapped once around power drum 2, as shown in the drawing. Until air clutch 8 is engaged by air supply 9, power drum 2 is free wheeling and rope 21 will freely move in either direction. Pulling rope 21 in either direction will cause power drum 2 to rotate since rope 2 is wrapped once around power drum 2 and power drum 2 is free wheeling as long as air clutch 8 is not engaged.

If air clutch 8 is now engaged by air supply 9, wind up mechanism 11 will be rotated by the chain and sprocket drive consisting of chain 20, sprocket 19 and sprocket 7. Wind up mechanism 11 is rotated in the direction of the arrows 22 and 23. When wind up mechanism 11 rotates in the direction of arrows 22 and 23, rope 21 is wound around drums 14 and 15 and rope 21 is thereby stopped and held from any further pay out in the direction indicated by the arrow 24. Any slippage in wind up mechanism 11 will cause further rotation of power drum 2, which will wind rope 21 until there is no slippage. Rope 21 is held under tension only in the direction indicated by arrow 24. If rope 21 is to be held under tension in both directions, rope 21 can be threaded through a second identical system. If a second system of the invention is utilized, this second system would be turned 180° from the position shown in the drawing and can be positioned either before wind up mechanism 11 or after powder drum 2. Note that instead of an entire system, a second power drum 2 could be used to hold rope 21 in both directions. This second power drum would be placed on the opposite side of wind up mechanism 11 from power drum 2.

While the invention has been described with reference to preferred embodiment, it will be obvious to those skilled in the art that various modifications and changes can be made to this embodiment without departing from the spirit and scope of the invention as defined in the claims.

I claim:

1. A device for stopping and holding a ropelike member adapted for line payout with respect with a first terminal comprising:

a base structure adapted for fixed mounting with respect said first terminal, said base structure including first and second rotatable means adapted for rotation about first and second axes, respectively, said first and second axes being disposed in spaced substantially parallel relation;

said first rotatable means being a drum means adapted for at least one complete wrap around of said ropelike member, said drum means being normally free wheeling in a selected direction of rotation when said ropelike member is being payed out from said first terminal;

said second rotatable means having an open center section adapted for unimpeded direct passage of said ropelike member therethrough when said second rotatable means has a selected angular disposition with respect said second axis;

means for interconnecting said first and second rotatable means, said means for interconnecting adapted such that when said first rotatable means is free wheeling in said selected direction of rotation, said second rotatable means is stationary with respect to said second axis and such that said first and second rotatable means will rotate in a like manner in the reverse direction of rotation;

power drive means coupled to said means for interconnecting and adapted to rotate said second rotatable means in said reverse direction of rotation, said power drive means including connect-disconnect coupling means normally in the disconnect operational state when said ropelike member is being payed out from said first terminal;

and means for energizing said connect-disconnect coupling means to change the operational state thereof whereby a compound friction engagement of said first and second rotatable means with said ropelike member results.

2. A device for stopping and holding a ropelike member as defined in claim 1 wherein said open center section of said second rotatable means is offset from said second axis thereof and is defined by an axially disposed shaft and one other shaft disposed in spaced, substantially parallel relation with respect said axially disposed shaft.

3. A device for stopping and holding a ropelike member as defined in claim 2 wherein said means for interconnecting said first and second rotatable means includes a chain drive interconnection.

* * * * *